US009625144B2

(12) United States Patent
Lynch

(10) Patent No.: US 9,625,144 B2
(45) **Date of Patent: *Apr. 18, 2017**

(54) MEMORIAL CANDLE HOLDER

(71) Applicant: Lindsay Lynch, Casselberry, FL (US)

(72) Inventor: Lindsay Lynch, Casselberry, FL (US)

( * ) Notice: Subject to any disclaimer, the term of this patent is extended or adjusted under 35 U.S.C. 154(b) by 250 days.

This patent is subject to a terminal disclaimer.

(21) Appl. No.: 14/618,553

(22) Filed: Feb. 10, 2015

(65) Prior Publication Data

US 2016/0230983 A1 Aug. 11, 2016

(51) Int. Cl.

| | |
|---|---|
| ***A61G 17/08*** | (2006.01) |
| ***F21V 35/00*** | (2006.01) |
| *F21V 33/00* | (2006.01) |
| *F21W 121/00* | (2006.01) |
| *F21S 10/02* | (2006.01) |
| *F21Y 115/10* | (2016.01) |

(52) U.S. Cl.

CPC ..... *F21V 35/00* (2013.01); *F21S 10/023* (2013.01); *F21V 33/0056* (2013.01); *F21W 2121/00* (2013.01); *F21Y 2115/10* (2016.08)

(58) Field of Classification Search

CPC ..... F21V 35/00; F21V 33/0056; F21S 10/023
USPC ..... 431/291, 288, 298; 27/1, 35; 52/128, 52/134

See application file for complete search history.

(56) References Cited

U.S. PATENT DOCUMENTS

| | | | | |
|---|---|---|---|---|
| 5,683,239 | A | 11/1997 | Cardosi | |
| 5,813,098 | A | 9/1998 | Schneider | |
| 6,023,822 | A | 2/2000 | Luebke | |
| 6,161,268 | A | 12/2000 | Joseph | |
| 6,520,606 | B1 | 2/2003 | Robinson | |
| 6,785,939 | B1 | 9/2004 | James | |
| 6,904,721 | B1 | 6/2005 | Forbes | |
| 7,036,195 | B2 | 5/2006 | Glass | |
| 7,174,611 | B1 | 2/2007 | Rose et al. | |
| 7,178,209 | B1 | 2/2007 | Radziewicz | |
| 7,562,423 | B2 * | 7/2009 | Pryd-Kakuk | A61G 17/08 27/1 |
| 7,987,564 | B2 | 8/2011 | Leeder | |
| 8,046,881 | B2 | 11/2011 | Johnson et al. | |
| 8,146,216 | B2 | 4/2012 | Creager | |
| 8,959,731 | B2 * | 2/2015 | Lynch | A61G 17/08 27/1 |
| 9,233,045 | B2 * | 1/2016 | Lynch | A61G 17/08 |
| 2006/0179623 | A1 | 8/2006 | Robinson | |
| 2009/0310374 | A1 * | 12/2009 | Lederer | F21S 6/001 362/392 |
| 2010/0043187 | A1 | 2/2010 | Steuer | |
| 2014/0047683 | A1 | 2/2014 | Cooke et al. | |
| 2015/0013123 | A1 | 1/2015 | Lynch | |

* cited by examiner

*Primary Examiner* — Gregory Huson

*Assistant Examiner* — Nikhil Mashruwala

(74) *Attorney, Agent, or Firm* — Jason T. Daniel, Esq.; Daniel Law Offices, P.A.

(57) ABSTRACT

A memorial candle holder includes a generally hollow main body having a candle holder along the top end, and one or more transparent commemorative item holders located along a middle portion. The main body is constructed from a translucent material, and a removable base unit having an illumination device is removably secured to the bottom of the main body.

15 Claims, 6 Drawing Sheets

MEMORIAL CANDLE HOLDER

TECHNICAL FIELD

The present invention relates generally to memorial devices, and more particularly to a memorial candle holder which can be customized for any number of different occasions.

BACKGROUND

The statements in this section merely provide background information related to the present disclosure and may not constitute prior art.

Life events such as weddings, baptisms, bah mitzvah's and funerals, for example, are often memorialized with commemorative items such as photographs and documents marking the occasion. In many instances, these items are placed within protective enclosures such as picture frames or photo albums, for example, and are only viewed from time to time. In some cultures, it is customary to light and display candles in remembrance of loved ones, or to mark special occasions.

With this in mind, it would be beneficial to provide a memorial candle holder device which can function to display and highlight commemorative items while providing a stable platform for a candle or other such illuminated object.

SUMMARY OF THE INVENTION

The present invention is directed to a memorial candle holder. One embodiment of the present invention can include a generally hollow main body having one or more commemorative item holders secured thereon. The main body can be translucent in nature, and the commemorative item holders can include a transparent section. A removable base unit can include a illumination device that is positionable within the hollow section of the main body, and can provide illumination to the body and commemorative item holder. A candle holder opening can be positioned along the top of the main body and can receive a candle holder.

Another embodiment of the present invention can include one or more decorative lights that are positioned along one or both of the main body and the base unit.

Yet another embodiment of the present invention can include one or more audio players that are positioned along one or both of the main body and the base unit.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
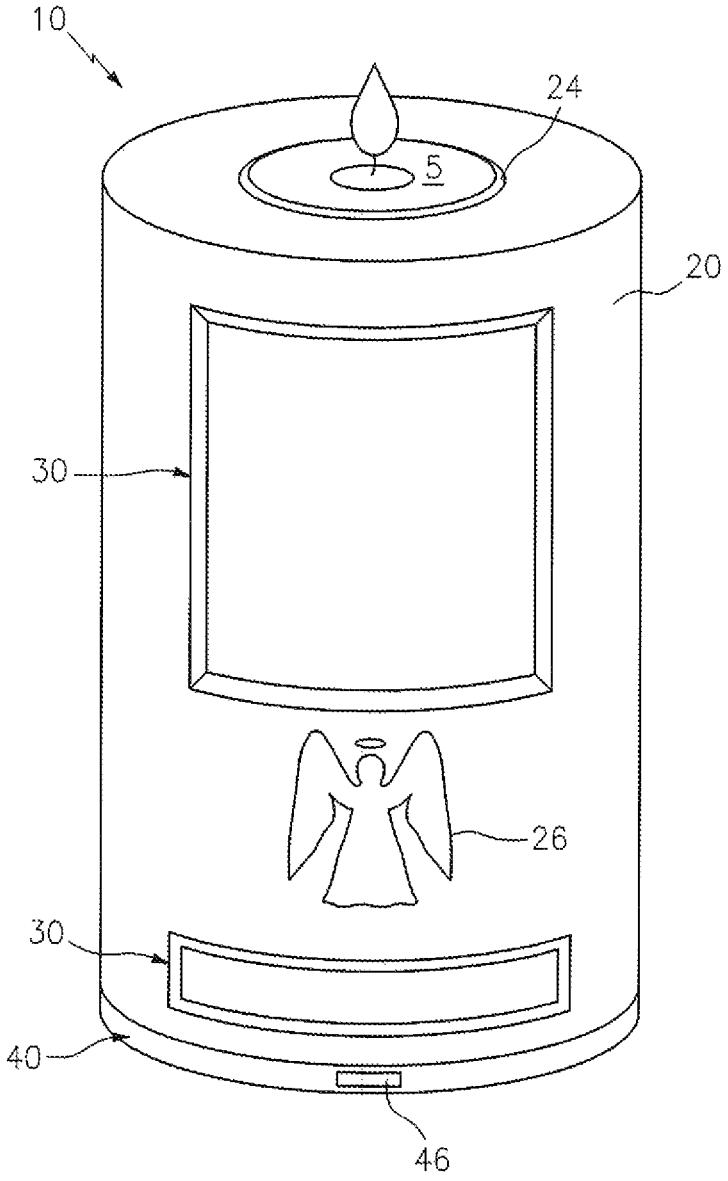
FIG. 1 is a perspective view of a memorial candle holder in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

The below described device can be utilized with, or form part of, the invention described in copending U.S. application Ser. No. 13/938,481 filed on Jul. 10, 2013, the contents of which are incorporated herein by reference.

As described herein, the terms "connector," "complementary connector" and derivatives thereof can include any number of different elements capable of repeatedly securing two items together in a nonpermanent manner. Several nonlimiting examples include opposing strips of hook and loop material (i.e. Velcro®), magnetic elements, tethers such as straps and ties, and compression fittings such as hooks, snaps, buttons and threaded elements designed to engage via a twisting motion, for example. Each illustrated connector can be permanently secured to, or incorporated into the design of, the illustrated portion of the device via known manufacturing techniques, a permanent sealer such as glue, adhesive tape, or stitching, for example.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a memorial candle holder device 10 that is useful for understanding the inventive concepts disclosed herein. As will be described below, the device 10 can include a main body 20, a candle holder 24, and an illuminated base unit 40 that can be removably secured to the main body.

Figure 2A:
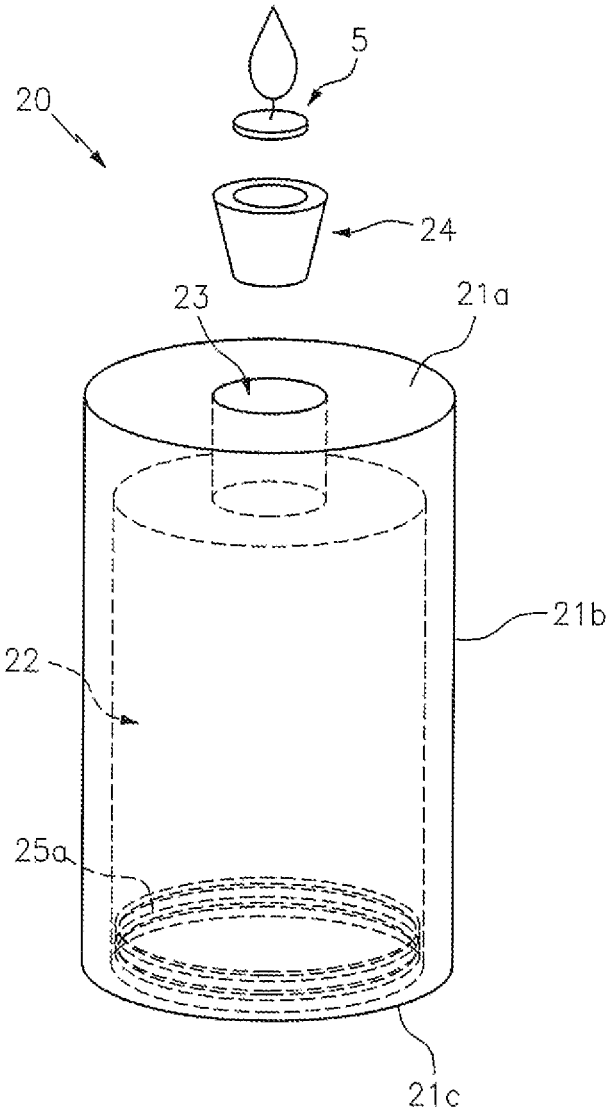
FIG. 2A is a perspective view of the main body of the memorial candle holder, in accordance with one embodiment of the invention.

FIG. 2A illustrates one embodiment of the main body 20. As shown, the main body 20 can include an elongated, generally hollow member having a top end 21*a*, a middle section 21*b* and a bottom end 21*c* that defines a generally hollow interior space 22. A candleholder opening 23 can also be disposed along the top end of the device. The opening 23 can terminate into the hollow interior space, and can function to receive a removable candle holder 24 into which a traditional candle 5 or other such device can be located. The candle holder 24 can be constructed from a fire resistant material such as glass or metal, for example, and can be particularly beneficial in instances where a user forgets to extinguish a burning candle before leaving the device unattended. To this end, the candle holder 24 can direct heat away from the device so as to prevent damage to the same.

A first connector 25*a*, such as the illustrated threaded elements, for example, can be disposed along the bottom end of the main body and can extend into the hollow interior space. The first connector can function to engage a complementary connector 25*b*, located on the base unit 40 described below.

Figure 2B:
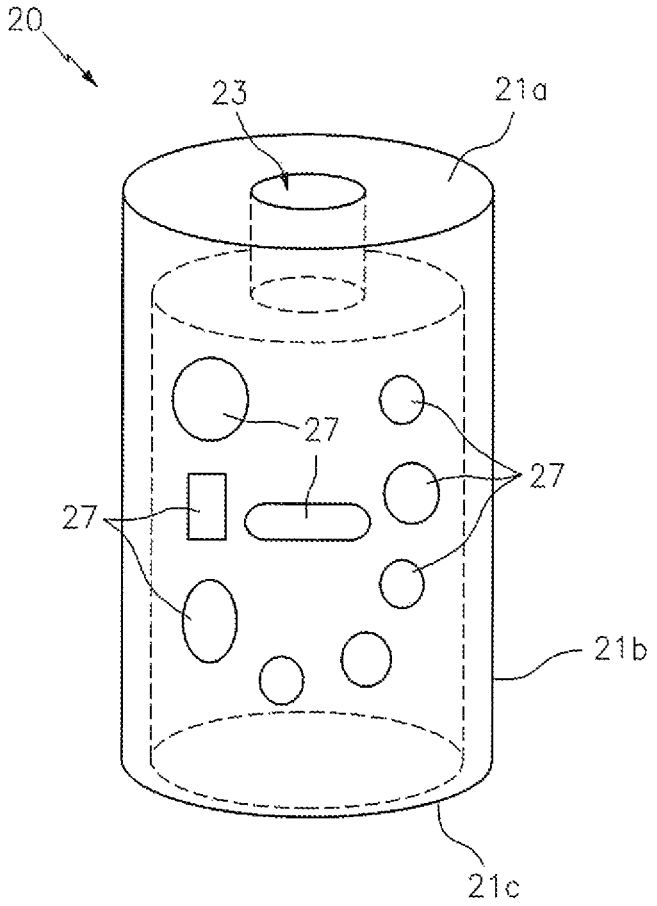
FIG. 2B is another perspective view of the main body of the memorial candle holder, in accordance with one embodiment of the invention.

As described herein, the main body can include any number of different shapes and sizes, and can preferably be constructed from a single piece of translucent plastic which can interact with the below described illumination device, so as to allow the main body to glow when the device is turned on. Of course, any number of other materials such as hardened plastic, PVC, glass and/or composite materials, for example, are also contemplated. Moreover, as shown in FIG. 2B, the main body can also be encrusted with translucent and/or transparent objects 27 such as faux jewels or other such objects which can extend to the hollow interior so as to interact with the below described illumination device in a manner that will allow each of the objects to glow.

The main body can further include an unlimited amount of decorative elements 26 that include, for example, various colors, markings, words, shapes, symbols, logos, designs, texturing of materials, and/or patterns. These decorative elements can be inlaid onto the main body 20 or can be raised/protruding outward from the main body 20, so as to give a three dimensional effect.

Figure 3:
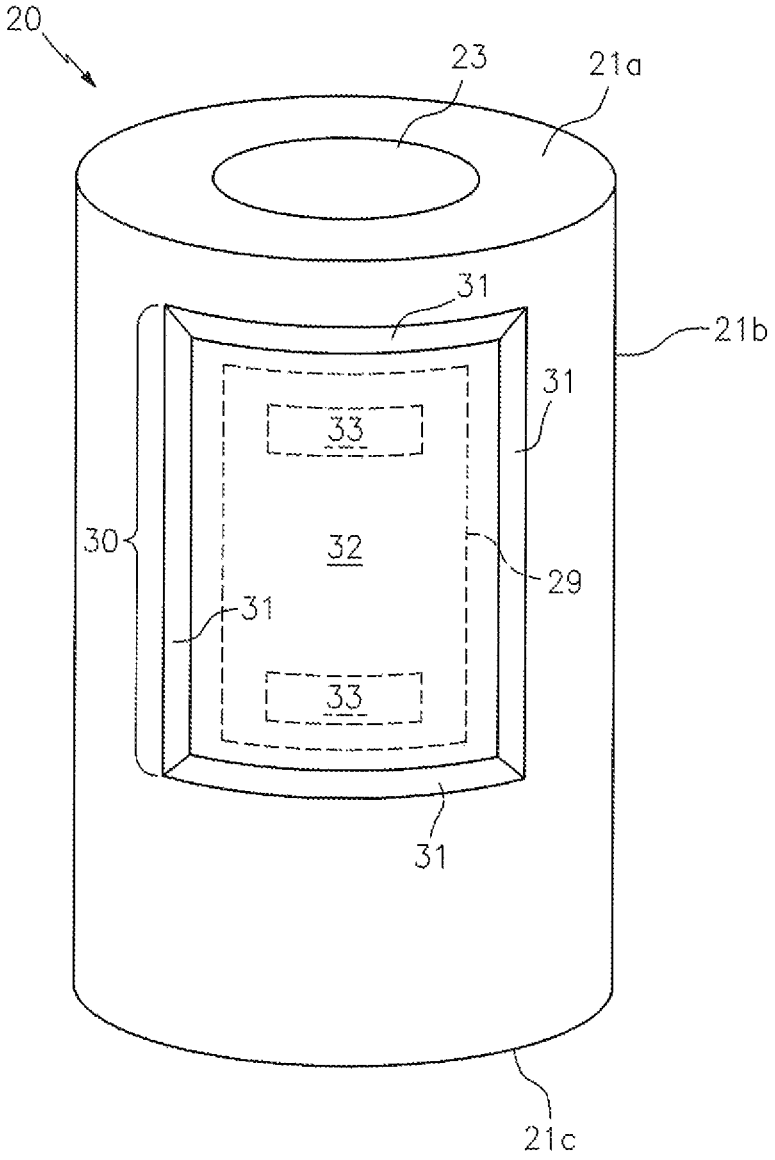
FIG. 3 is another perspective view of the main body of the memorial candle holder, in accordance with one embodiment of the invention.

As shown best in FIG. 3, the main body can further include one or more commemorative item holders 30. In one embodiment, each of the commemorative item holders can include a plurality of raised or recessed lip/edge sections 31 which can function to receive and engage the edges of a commemorative item such as a photograph, painting, drawing, document, or other such item, for example, and to securely position the same onto the main body 20. As shown, each of the lip sections 31 can be disposed about an aperture 29 in the main body that extends into the hollow interior space. A generally transparent back section 32 can be disposed across the aperture 29 and between the lip sections 31, and can function to direct light from the below described illumination device onto/through an inserted commemorative item.

In the preferred embodiment, each of the lip/edge sections can preferably be constructed from a substantially identical material as the main body 20, and the back section 32 can be constructed from clear plastic. Of course, any number of other suitable materials are also contemplated.

In another embodiment, one or more item connectors 33 such as double sided tape, for example, can be provided onto the back section 32 to further secure a commemorative item within the holder 30. Double sided tape is particularly advantageous in this embodiment, as the clear nature of the tape will not impede light passing through the back section.

Figure 4:
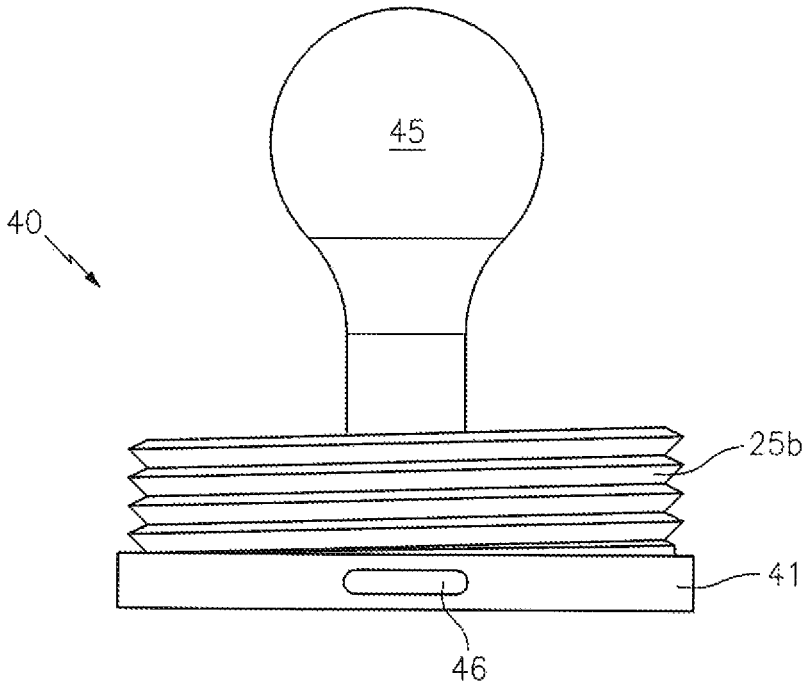
FIG. 4 is a front side view of the base unit of the memorial candle holder, in accordance with one embodiment of the invention.

As shown in FIG. 4, the device 10 can further include a base unit 40 having a body section 41, a plurality of complementary connectors 25*b* extending from the body section, and an illumination device 45 such as a light bulb, LED strip or other such device that is controlled by a switch 46. The base unit 40 can engage the main body 20 via connectors 25*a* and 25*b*, so as to position the illumination device 45 within the hollow interior space 22 of the main body. In the preferred embodiment the illumination device can be powered by one or more batteries (not illustrated) or can be powered by an AC outlet via a cord (not illustrated). Moreover, the base unit 40 can also be emblazoned with any number of decorative elements 26, as shown below.

Figure 5:
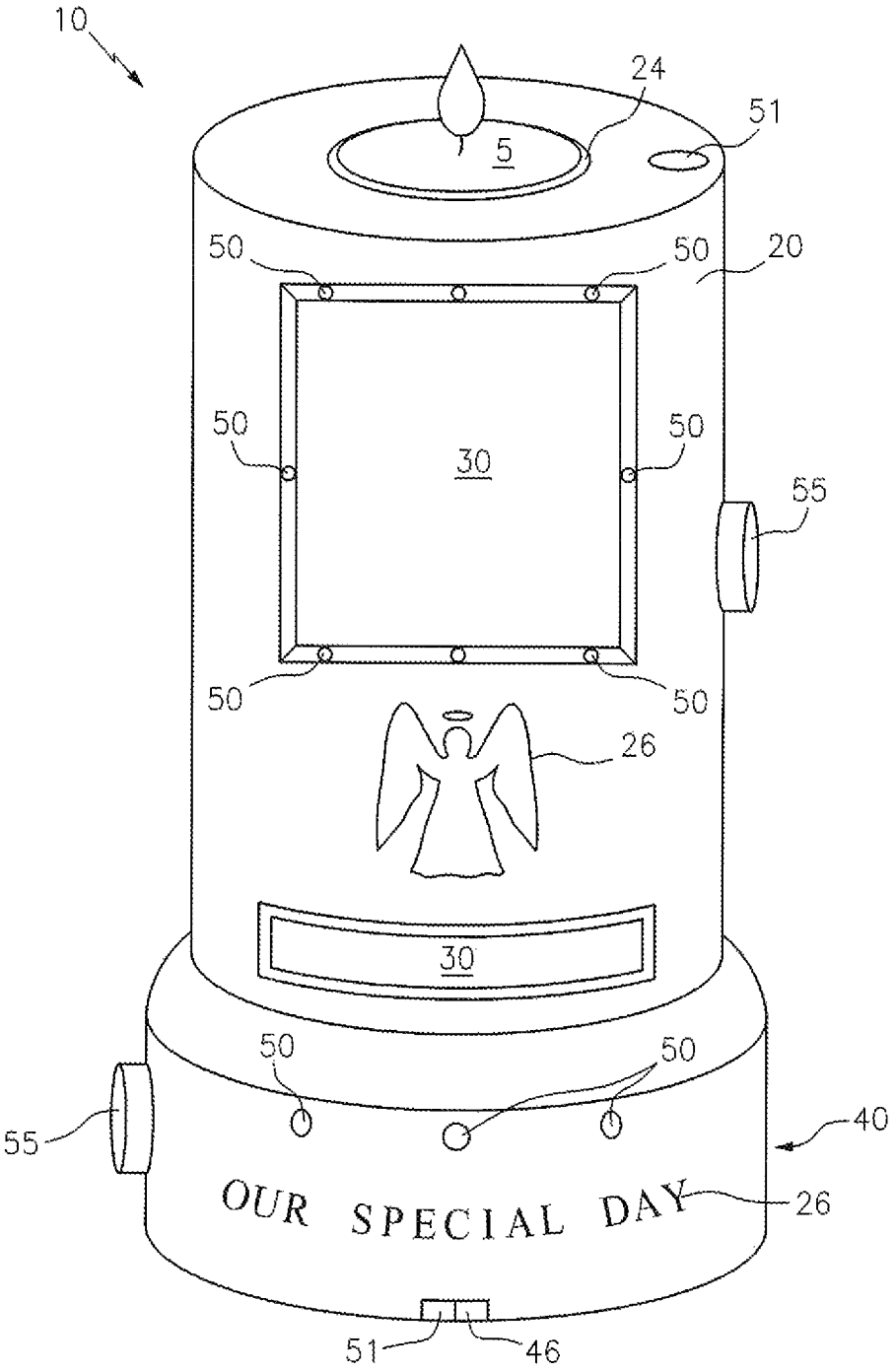
FIG. 5 is a perspective view of the memorial candle holder, in accordance with one embodiment of the invention.

FIG. 5 illustrates another embodiment of the device 10 wherein one or both of the main body 20 and the base unit 40 further include one or more decorative lights 50 which can function to enhance the aesthetics of the device. In the preferred embodiment, each of the lights 50 can include light-emitting-diodes (LED), for example, having any number of different colors. The device can further include functionality to cause the decorative lights to perform a lighting effect such as to flash, change color, or perform a chasing pattern based on an instruction from a switch 51. The lights can preferably be powered by one or more batteries (not illustrated) or can be powered by an AC outlet via a cord (not illustrated).

In another embodiment, an audio device 55 such as an MP3 player, or other such voice recorder can be provided onto the main body and/or the base unit so as to allow a user to load a stored voice message or favorite song from a loved one. Digital media players such as an MP3 player are extremely well known in the art.

Although described or illustrated with regard to a particular shape and/or construction material, this is for illustrative purposes only, as the main body 20 and the base unit 40 can be constructed from any number of suitable materials, can include any number of different shapes. Moreover, by utilizing connectors and complementary connectors, the base unit 40 and main body 20 can be interchangeable in nature, so as to allow a user to change the appearance of the device.

In operation, a user can position any number of commemorative items on the commemorative item holders, and can activate the illumination device. When activated, the illumination device can function to fully illuminate the inserted commemorative item, and to partially illuminate the main body and/or any objects 27. Moreover, the light can also extend upward through the candle holder opening when no candle is inserted, thus giving the effect of candle light. This can also be accomplished when utilized with a candle holder that is constructed from glass or other such transparent materials.

As described herein, one or more elements of the memorial candle holder device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that any number of different individual elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A memorial candle holder device, comprising:

a main body having an elongated, generally hollow interior space;

one or more commemorative item holders that are disposed along the main body, said holders functioning to receive and securely position a commemorative item onto the main body;

a candle holder opening disposed along a top end of the main body, said opening being in communication with the hollow space;

a base unit having an illumination device secured thereon, said base unit being removably secured to a bottom section of the main body so as to position the illumination device within the hollow space; and a generally fire resistant candle holder that is configured to be positioned within the candle holder opening, said candle holder including a shape that is conducive for receiving a candle and to direct any heat produced from the candle away from the device.

2. The device of claim 1, wherein the main body is constructed from a translucent material.

3. The device of claim 1, wherein each of the commemorative item holders further includes a generally transparent section that functions to allow light from the illumination device to illuminate an inserted commemorative item.

4. The device of claim 1, wherein each of the commemorative item holders includes a plurality of lip sections that are disposed about an aperture in the main body that extends into the hollow interior space, and a generally transparent back section that is disposed across the aperture and between the lip sections.

5. The device of claim 1, further comprising:

one or more decorative lights that are disposed along the main body.

6. The device of claim 5, wherein the device further includes a decorative light switch having functionality to cause each of the one or more decorative lights to perform a lighting effect.

7. The device of claim 1, further comprising:

one or decorative lights that are disposed along the base unit.

8. The device of claim 7, wherein the base unit further includes a decorative light switch having functionality to cause each of the one or more decorative lights to perform a lighting effect.

9. The device of claim 1, wherein the main body and the base unit include different shapes.

10. The device of claim 1, further comprising:

one or more decorative elements that are located along the main body.

11. The device of claim 1, further comprising:

a pair of connectors and complementary connectors disposed along the main body and the base unit, respectively, said connectors and complementary connectors being configured to engage an outer shell and base unit in a non-permanent manner.

12. The device of claim 11, wherein said connectors and complementary connectors include a plurality of threaded elements.

13. The device of claim 1, further comprising:

an audio device that is located along the main body.

14. The device of claim 1, further comprising:

an audio device that is located along the base unit.

15. The device of claim 1, wherein the base unit is interchangeable between a plurality of different main bodies.

* * * * *